United States Patent [19]

Fukui et al.

[11] 4,009,460

[45] Feb. 22, 1977

[54] INDUCTOR

[75] Inventors: Masahiko Fukui, Kumagaya; Yasuji Kamata, Hitachi, both of Japan

[73] Assignees: Hitachi Metals, Ltd.; Hitachi, Ltd., both of Japan

[22] Filed: Sept. 19, 1975

[21] Appl. No.: 614,943

[30] Foreign Application Priority Data

Sept. 24, 1974 Japan ..... 49-108752
Sept. 24, 1974 Japan ..... 49-108753

[52] U.S. Cl. ..... 336/110; 336/155; 336/178; 336/212; 336/215; 336/219

[51] Int. Cl.[2] ..... H01F 21/00

[58] Field of Search ..... 336/110, 155, 160, 165, 336/178, 219, 212, 214, 215; 323/92, 89 AG

[56] References Cited

UNITED STATES PATENTS

| | | | |
|---|---|---|---|
| 2,306,998 | 12/1942 | Claesson | 336/110 X |
| 2,802,170 | 8/1957 | Starr et al. | 336/155 X |
| 2,831,157 | 4/1958 | Grayson et al. | 336/110 X |
| 2,866,943 | 12/1958 | Ringelman | 336/110 X |

*Primary Examiner*—Thomas J. Kozma
*Attorney, Agent, or Firm*—Craig & Antonelli

[57] ABSTRACT

An inductor having a coil member commonly wound on a couple of closed magnetic circuits made of a soft magnetic material. A magnetic gap is provided at a part of the soft magnetic material of at least one of the two closed magnetic circuits, and a permanent magnet providing a magnetic bias is inserted in the magnetic gap. This inductor is used in series between a DC power source providing a superimposed current of a DC current and an AC current and a load. The inductance of the inductor is very large with respect to a small DC current, while it reduces sharply when the applied DC current increases to be a certain value to show a substantially constant low value with respect to a DC current value beyond the certain value.

13 Claims, 6 Drawing Figures

INDUCTOR

BACKGROUND OF THE INVENTION

1. Field of the Invention

The present invention relates to an inductor with a coil wound on a magnetically biased magnetic core, that is, a magnetic core having a permanent magnet, for giving a magnetic bias to a magnetic circuit, disposed in a magnetic gap which is provided at a part of the magnetic circuit.

2. Description of the Prior Art

The inductor according to the present invention is suitable for use in a switching regulator of a DC stabilized power device or the like.

The inductor used in a switching regulator or the like is required to have a large inductance with respect to a small DC current and a small inductance with respect to a large DC current. However, there has not been any inductor having such an inductance characteristic as described above, so that it is common practice to obtain an inductor having such a characteristic by connecting in series an inductor having a biased magnetic core with an ordinary inductor having no biased magnetic core.

However, the method of obtaining an inductor having any kind of inductance characteristic by assembling a plurality of inductors has such defects that the electric circuit is complicated and the cost of the inductor is high.

SUMMARY OF THE INVENTION

Accordingly, it is an object of the present invention to provide an assembled inductor having such an inductance characteristic as to show a high inductance with respect to a small DC current and a low inductance with respect to a large DC current.

The inductor according to the present invention has a coil commonly wound on first and second magnetic circuits, the first magnetic circuit is made of a soft magnetic material and the second magnetic circuit is made of a soft magnetic material having a magnetic gap in which a permanent magnet giving a magnetic bias to the second magnetic circuit is disposed.

Desirably, the inductor according to the present invention comprises a first magnetic circuit of a soft magnetic material having a magnetic gap, a second magnetic circuit of a soft magnetic material having a magnetic gap narrower than that in the first magnetic circuit, a coil wound commonly on the first and second magnetic circuits, and a permanent magnetic member disposed in the magnetic gap of the first magnetic circuit to give a magnetic bias to the first magnetic circuit and produce magnetic flux flowing in the magnetic gap through the first magnetic circuit.

Further, preferably, a non-magnetic member may be inserted between the two magnetic circuits so as to reduce magnetic interference which may act therebetween.

DESCRIPTION OF THE PREFERRED EMBODIMENT

Embodiments of the present invention employ magnetic circuits which are respectively composed of two magnetic core members selected from members of E-, I- and U-shaped types each made of such a soft magnetic material such as Mn-Zn ferrite, Ni-Zn ferrite or silicon steel plate, and magnetic circuits selected from circuits of EI-, EE-, UI- and UU-shaped types are employed as a magnetic core of the inductor.

According to the present invention, there is provided an assembly of a magnetic circuit having a permanent magnet member disposed in the magnetic gap of the magnetic core thereof, i.e. a magnetically biased magnetic circuit, and a magnetic circuit having no permanent magnet member, i.e. a normal magnetic circuit, and a coil commonly wound on the two magnetic circuits. Preferably, there is provided an assembly of the two magnetic circuits disposed face to face and the coil.

Figure 1:
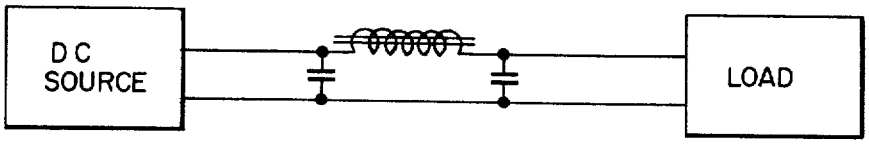
FIG. 1 is a diagram showing an application of the present invention.

The inductor according to the present invention is used in series between a DC power source, for providing a superimposed current of a DC current and an AC current, and a load as shown in FIG. 1, and the superimposed current flows through the coil of the inductor. The DC power source comprises a switching circuit. The inductor is connected in an electrical circuit in such a manner that the DC current produces a magnetic field in the magnetic core in a direction opposite to the direction of magnetic flux produced by the permanent magnet in the magnetically biased magnetic circuit.

When a small DC current flows through the coil of the inductor, the magnetic core forming the two magnetic circuits is not saturated and therefore exhibits a large inductance.

Generally, the inductance L of a magnetic core is shown as follows;

$$L \propto \mu S$$

where $\mu$ is the magnetic permeability of the magnetic core and S is the sectional area thereof.

When a small DC current flows through the coil wound on the magnetic core, the inductance L of the magnetic core is represented as follows;

$$L \propto \mu_B . S_B + \mu_n . S_n$$

where $\mu_B$ is the magnetic permeability of the magnetic core of the magnetically biased magnetic circuit, $S_B$ is the sectional area thereof, $\mu_n$ is the magnetic permeability of the core of the ordinary magnetic circuit, and $S_n$ is the sectional area thereof.

As a DC current flowing through the coil increases to be a certain value, the magnetic core of the normal magnetic circuit is saturated by the magnetic field generated by the coil, so that the magnetic permeability of the magnetic core $\mu_n$ reduces to a very small value. As a result, the inductance of the inductor becomes almost equal to $\mu_B . S_B$ which is an inductance of the magnetic core of the magnetically biased magnetic circuit of a small value. Under this condition, in the magnetically-biased magnetic circuit, the DC magnetic field generated by the coil is decreased by the permanent magnet inserted in the magnetic gap and becomes small, so that the magnetic core of the magnetically biased magnetic circuit remains unsaturated magnetically.

In this way, the inductance value of the inductor according to the present invention is large with respect to a small DC current, while it reduces sharply with respect to the certain DC current value which is almost enough to saturate the magnetic core of the biased magnetic circuit, and it is kept small with respect to a large DC current larger than the certain DC current value.

In the present invention, it is effective to adjust the length of the magnetic gap in the magnetically biased magnetic circuit to be longer than that in the ordinary magnetic circuit. Namely, in this case, if the magnetic cores of the two magnetic circuits are made of the same material, an average magnetic permeability of the ordinary magnetic circuit is larger than that of the magnetically-biased magnetic circuit. Therefore, it is possible to cause a very great change in inductance value of the inductor when the magnetic core of the ordinary magnetic circuit is saturated by the DC current.

Further, it is preferable in the present invention to reduce the magnetic interference between the ordinary magnetic circuit and the magnetically-biased magnetic circuit by inserting a non-magnetic material therebetween. In this case, a magnetic gap is provided between the magnetic core of the magnetically-biased magnetic circuit and the magnetic core of the ordinary magnetic circuit which are disposed face to face, and a spacer is inserted in the magnetic gap. Therefore, magnetic flux generated by the permanent magnet in the biased magnetic circuit never passes through the magnetic core of the ordinary magnetic circuit. Further, neither of the DC and AC magnetic field in the two magnetic circuits generated by the coil affect each other. Namely, the thus constructed inductor has the complex characteristics such as combining the characteristics of an inductor having the biased magnetic circuit and those of an inductor having the normal magnetic circuit without interfering with the characteristics thereof each other.

The spacer may be made of such a non-magnetic material as plastic, aluminum or paint which does not cause any magnetic interference between the two magnetic cores, and the two magnetic cores may be fixed and held through the spacer with a certain space therebetween. Preferably, this spacer may be made of an insulating material.

The present invention will be described more in detail below with reference to an embodiment.

Figure 2:
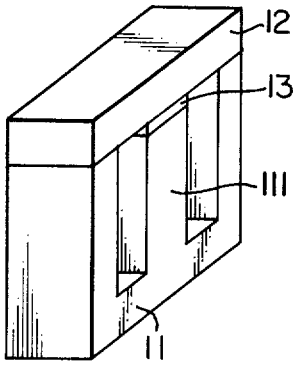
FIG. 2 and FIG. 3 are perspective views showing iron cores used in the inductor according to the present invention.

As shown in FIG. 2, a central leg III of the magnetic core 11, 12 of EI-shaped type made of Mn-Zn ferrite is slightly shortened to provide an air gap. A permanent magnet 13 of rare earth cobalt group is disposed in the air gap in such a direction that the magnetizing polarity of the magnet 13 is opposite to the direction of the DC magnetic flux generated by the coil wound on the magnetic core. When a coil is wound on this central leg 111 to form a first inductor, the inductance value of a first inductor as shown by a characteristic curve A in FIG. 6 is obtained.

Figure 3:
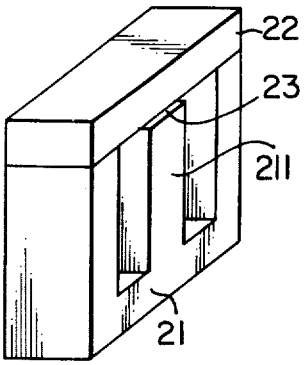
Figure 6:
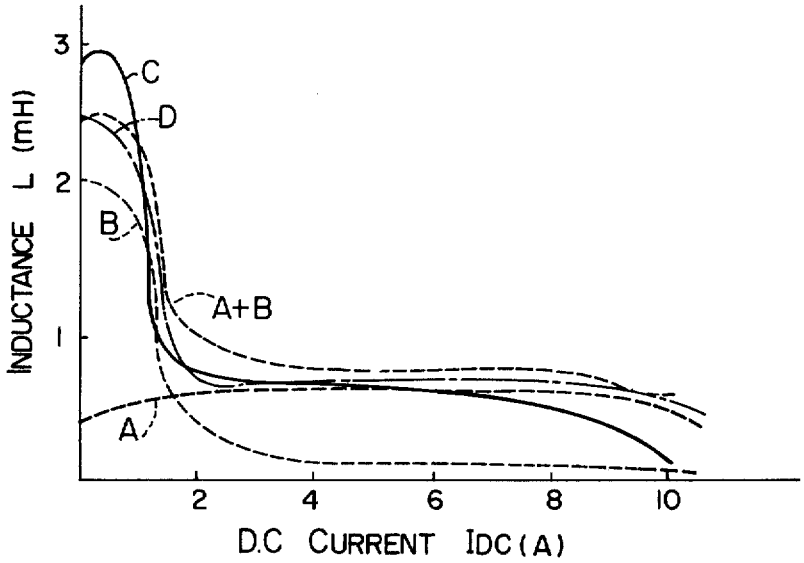
FIG. 6 is a graph showing the relation between the inductance L of the inductor according to the invention and the DC current $I_{DC}$ applied thereto.

In FIG. 3, when a coil is wound on central leg 211 of a magnetic core 21, 22 of EI-shaped type which is made of Mn—Zn ferrite to form a second inductor without inserting any material in an air gap 23 provided at the central leg 211, the inductance value of the second inductor is represented by a curve B in FIG. 6. The air gap 23 between the central leg 211 and the magnetic core of I-shaped type 22 is 0.08mm long, which is smaller than the 1.4mm length of the air gap provided between the E-shaped type magnetic core 11 and the I-shaped type magnetic core 12.

Figure 4:
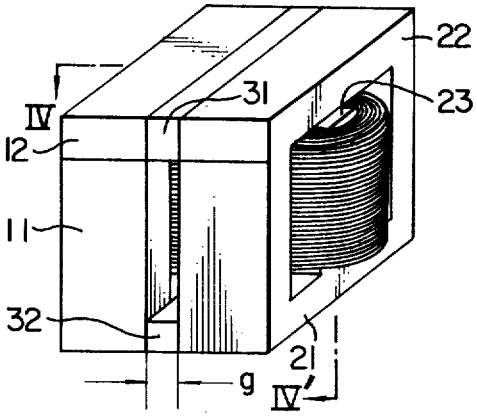
FIG. 4 is a perspective view showing an inductor according to the present invention.
Figure 5:
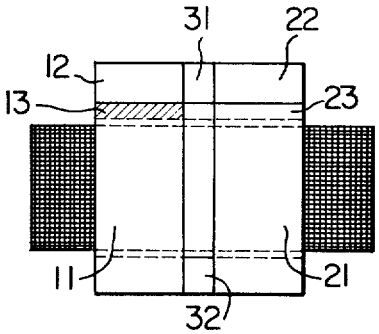
FIG. 5 is a sectional view of the inductor according to the present invention taken in line IV–IV' in FIG. 4.

The magnetic core 11, 12 of EI-shaped type and the magnetic core 21, 22 of EI-shaped type are disposed face to face as shown in FIG. 4, and a common coil wound on the central legs 111 and 211 to form a third inductor. In the absence of the gap g between two sets of magnetic cores 11, 12 and 21, 22 of EI-shaped type, an inductance characteristic as shown in a curve C of FIG. 6 is obtained. In this case, the inductance value of the third inductor is large with respect to a low DC current and reduces sharply at a certain DC current value larger than the low DC current, further the inductance value is a substantially constant low value with respect to a DC current larger than the certain DC current.

In the presence of gap *g*, on the other hand, when plastic spacers 31 and 32 of 3mm to 12mm long are inserted in the gap *g*, the inductance characteristic of the third inductor may be shown by the curve D of FIG. 6. Namely, the characteristic of the third inductor as shown by the curve D is almost equal to the sum of the characteristic of the first inductor shown by the curve A and that of the second inductor shown by the curve B. In this way, a non-magnetic material disposed between the two magnetic cores eliminate magnetic interference between the two magnetic cores.

Now, in the present invention, when no air magnetic gap is provided in the magnetic core of the ordinary magnetic circuit, the magnetic permeability of the ordinary magnetic circuit having no air gap is larger than that of the ordinary magnetic circuit having an air gap. Therefore, a DC current value which saturates the ordinary magnetic circuit having no air gap is lower than that which saturates the ordinary magnetic circuit having an air gap, so that the inductance value of the inductor whose ordinary magnetic circuit has no air gap reduces sharply with respect to a lower DC current when compared with the inductor whose ordinary magnetic circuit has an air gap.

Next, in the magnetic core of a magnetically biased circuit, when the permanent magnet is arranged in the air gap leaving a part of the gap unfilled, the magnetic permeability of such a magnetic core is lower at a large DC current value when compared with that of a magnetic core of a magnetically-biased circuit whose air gap is filled with a permanent magnet. In this case, the DC current value at which the inductance value of the inductor sharply changes remains unchanged, while the inductance value of the inductor with respect to a DC current value which is enough to saturate the normal magnetic core becomes lower.

If an insulating material is used as a spacer inserted in the gap, heat due to eddy currents is not generated and a stable inductance characteristic may be achieved even when an AC current of a high frequency flows through the coil.

Further, the inductor according to the invention may utilize the technique of the magnetically-biased magnetic core which has already been developed. If a permanent magnet is divided into a plurality of small portions, or grooves are formed on the permanent magnet or a powdered magnet is molded with resin, as disclosed in U.S, Ser. No. 471,157, now U.S. Patent No. 3,968,465, INDUCTOR AND METHOD FOR PRO- DUCING SAME to Fukui et al., for example, it is possible to prevent eddy currents which otherwise might occur in the permanent magnet. Application of such a technique to the inductor according to the present invention is very effective.

Even though the foregoing description involves an inductor with a composite magnetic core having one magnetically-biased core and one ordinary magnetic core, the present invention may be embodied with equal effect by using a plurality of magnetically-biased cores and/or a plurality of ordinary magnetic cores.

What is claimed is:

1. An inductor comprising:

a first magnetic circuit which includes at least one magnetic core formed from a soft magnetic material, at least one airgap formed in a portion thereof, and a permanent magnetic member disposed in said one airgap to produce magnetic flux flowing through said first magnetic circuit;

a second magnetic circuit including at least one magnetic core formed from a soft magnetic material; the magnetic core of said second magnetic circuit being disposed face to face with the magnetic core of said first magnetic circuit; and coil means wound around adjacent portions of said magnetic cores in common to produce a magnetic flux therein.

2. An inductor as set forth in claim 1 wherein said magnetic cores of said first and second magnetic circuits have the same configuration.

3. An inductor as set forth in claim 2 wherein a spacer formed from a non-magnetic material is disposed between said adjacent magnetic cores to space said cores out of contact with one another and thereby to reduce magnetic interference therebetween.

4. An inductor as set forth in claim 1 wherein said second magnetic circuit has at least one airgap formed in a portion thereof.

5. An inductor as set forth in claim 1 wherein said one airgap is filled with said permanent magnetic member.

6. An inductor as set forth in claim 1 wherein said one airgap includes said permanent magnetic member and a remaining part of said airgap.

7. An inductor as set forth in claim 4 wherein said one airgap provided in said first magnetic circuit is longer than that provided in said second magnetic circuit.

8. An inductor as set forth in claim 7 wherein said magnetic cores of said first and second magnetic circuits have the same configuration.

9. An inductor as set forth in claim 4 wherein a spacer formed from a non-magnetic material is disposed between said adjacent magnetic cores to space said cores out of contact with one another and thereby to reduce magnetic interference therebetween.

10. An inductor as set forth in claim 1 wherein said coil means is wound in a direction which will produce a magnetic field in said first and second magnetic circuits which is in a direction opposite to the direction of magnetic flux produced by the permanent magnetic member therein.

11. An inductor as set forth in claim 1 wherein the core in said first and second magnetic circuits each comprise an E-shaped member and an I-shaped member extending between the outer legs of said E-shaped member, the center leg in each core being shorter than the outer legs thereof to provide a gap with said I-shaped member, said coil means being wound around the center legs of said respective cores in common.

12. An inductor as set forth in claim 11 wherein a spacer formed from a non-magnetic material is disposed between said adjacent magnetic cores to space said cores out of contact with one another and thereby to reduce magnetic interference therebetween.

13. An inductor as set forth in claim 11 wherein said one airgap provided in said first magnetic circuit is longer than that provided in said second magnetic circuit.

* * * * *